US005689767A

United States Patent [19]

Domoto et al.

[11] Patent Number: 5,689,767

[45] Date of Patent: Nov. 18, 1997

[54] ISOTHERMALIZING MEMBER FOR A PRINTING MACHINE

[75] Inventors: Gerald A. Domoto, Briarcliff Manor; Elias Panides, Hartsdale; Karl B. Ayash, Webster; Thomas C. Hollar, Penfield; Michael J. Martin, Hamlin, all of N.Y.

[73] Assignee: Xerox Corporation, Stamford, Conn.

[21] Appl. No.: 551,088

[22] Filed: Oct. 31, 1995

[51] Int. Cl.[6] ..... G03G 21/20

[52] U.S. Cl. ..... 399/94; 219/216; 219/469; 399/96; 399/222; 399/320

[58] Field of Search ..... 399/94, 96, 222, 399/320, 331, 334; 219/216, 469, 470

[56] References Cited

U.S. PATENT DOCUMENTS

| | | | |
|---|---|---|---|
| 4,091,264 | 5/1978 | Sarcia | 219/469 |
| 4,172,976 | 10/1979 | Namiki et al. | 219/469 |
| 4,229,644 | 10/1980 | Namiki et al. | 219/469 |
| 4,284,875 | 8/1981 | Namiki et al. | 219/216 |
| 5,089,857 | 2/1992 | Xydias | 399/401 |
| 5,119,142 | 6/1992 | Swapceinski et al. | 399/331 |
| 5,426,495 | 6/1995 | Sawamura et al. | 399/331 |

*Primary Examiner*—William J. Royer
*Attorney, Agent, or Firm*—Kevin R. Kepner

[57] ABSTRACT

An apparatus for maintaining a uniform temperature along its axis by increasing the heat transfer efficiency. The apparatus uses a sealed chamber containing a substantially pure working fluid in a two phase (liquid and vapor) condition. The vaporization and condensation of the fluid increases the heat transfer efficiency and tends to equalize temperature gradients in a body in contact with the apparatus. The apparatus is utilized in various locations in an electrophotographic printing machine and can be used as a pressure roll for a heat and pressure fuser, a support or drive roll for a photoreceptive member, a support member for a photoreceptor and a heat sink for a developer housing.

10 Claims, 3 Drawing Sheets

ISOTHERMALIZING MEMBER FOR A PRINTING MACHINE

This invention relates generally to an isothermalizing member for a printing machine, and more particularly concerns a member which provides a very uniform temperature along its axis and a high heat transfer efficiency.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

As printing machines move to higher quality, more stringent control of internal temperatures is required. Heat sources and airflow within printing machines cause temperature variations on photoreceptor belts, within developer housings and in fusing assemblies. High quality printing machines require a device or devices to minimize the temperature variation for the components.

It is desirable to achieve a uniform temperature distribution on the surface of a photoreceptor roll or backer bar, within a developer housing or across a fuser assembly. Accordingly, it is desirable to develop a heat exchanger or isothermalizing member which has good heat transfer properties and is able to be maintained at a uniform axial temperature.

The following disclosures may be relevant to various aspects of the present invention:

U.S. Pat. No. 5,119,142

Inventor: Swapcienski et al.

Issue Date: Jun. 2, 1992

The relevant portions of the foregoing disclosures may be briefly summarized as follows:

U.S. Pat. No. 5,119,142 describes an image fixing device in which a heat exchanging roller removes heat from a portion of a belt exiting a fusing nip and returns the heat to a portion of the belt entering the nip. The heat exchanging roller has a thin conducting layer on an insulative core.

In accordance with one aspect of the present invention, there is provided a printing machine having an apparatus for equalizing the temperature of a body in contact with the apparatus. The apparatus comprises a sealed chamber and a fluid contained within said sealed chamber, said fluid being in a two-phase (liquid and vapor) condition near thermodynamic equilibrium.

Pursuant to another aspect of the present invention, there is provided a method of maintaining a uniform temperature of a body in a printing machine. The method comprises maintaining a substantially pure fluid or combination of pure fluid substances in a two-phase (liquid and vapor) condition near thermodynamic equilibrium in a sealed member and contacting the body with the sealed member so that the temperature of the body is equalized by the transfer of heat through the sealed member Other features of the present invention will become apparent as the following description proceeds and upon reference to the drawings, in which:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
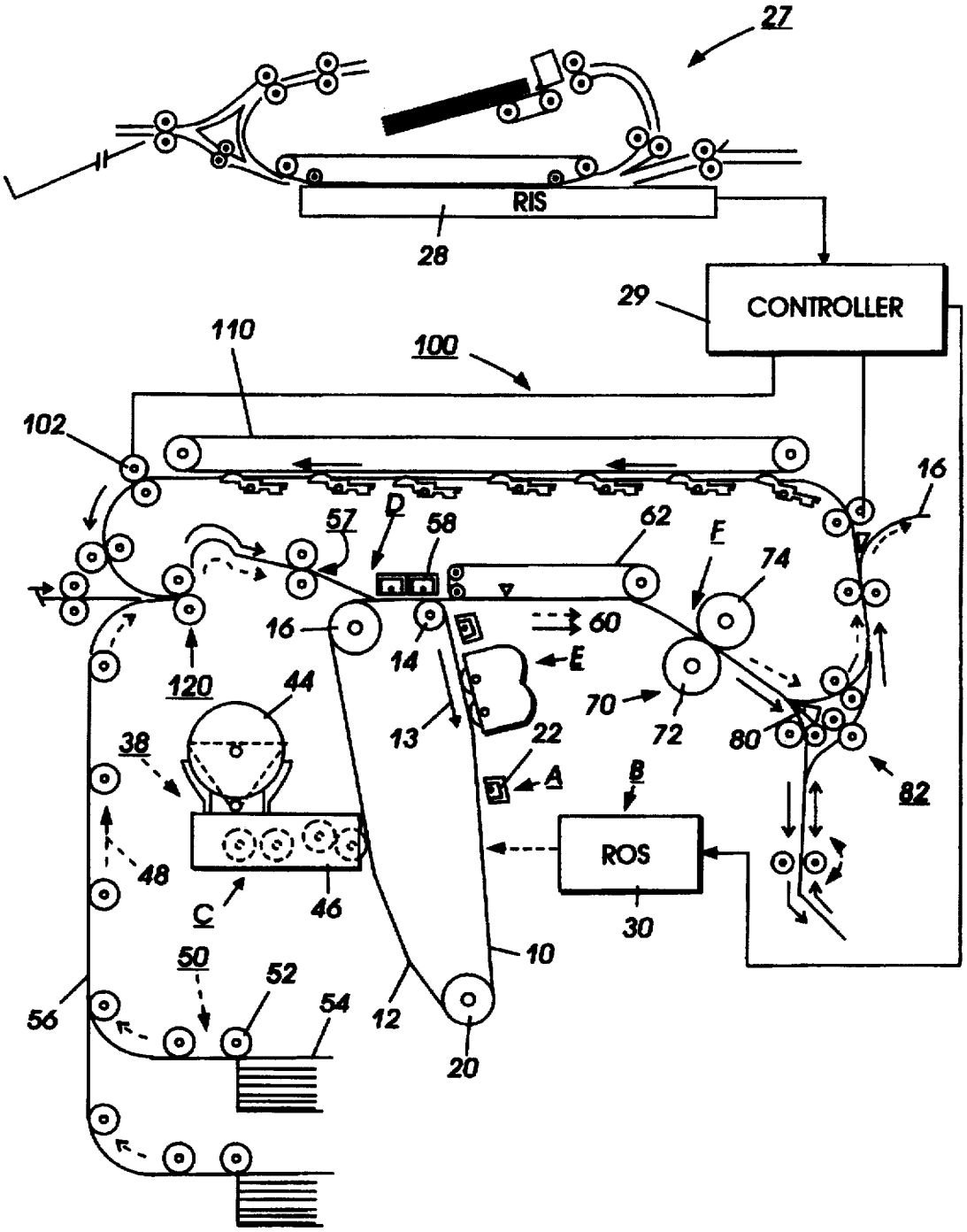
FIG. 1 is a schematic elevational view of an electrophotographic printing machine incorporating the isothermalizing device of the invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via output 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
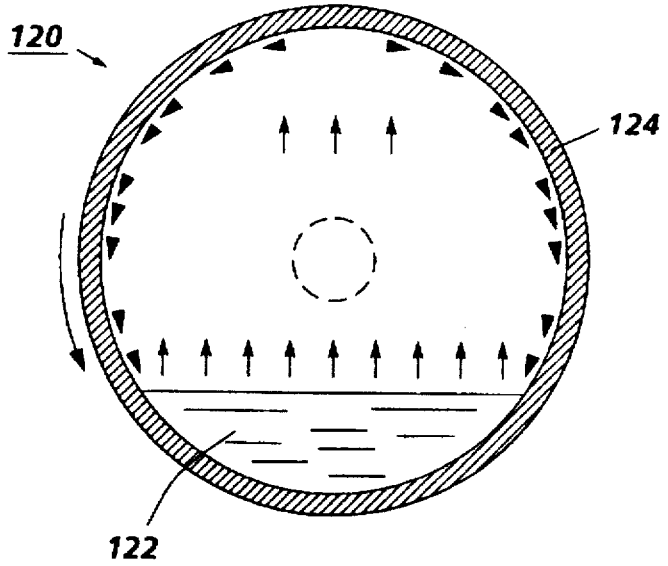
FIG. 2 is a side elevational view of an isothermalizing device as described herein.

The underlying idea as illustrated in FIG. 2, is to utilize the phase change of a pure substance contained within the sealed chamber of the isothermalizer member 120. The isothermalizer member 120, illustrated in FIG. 2 as a roll, is a sealed chamber, evacuated of air and any other non-condensible substances and should contain only the pure working fluid 122 in vapor-liquid equilibrium. Water is viable for room temperature and temperatures up to slightly above 100 degrees C. and is preferable due to its high latent heat of vaporization. Any working fluid with relatively high latent heat and equilibrium pressure temperature characteristics consistent with the structural strength of the roll material and geometry can be used. The roll 124 should be as thin as is structurally viable, having a high radial thermal conductance (e.g. copper).

Figure 3:
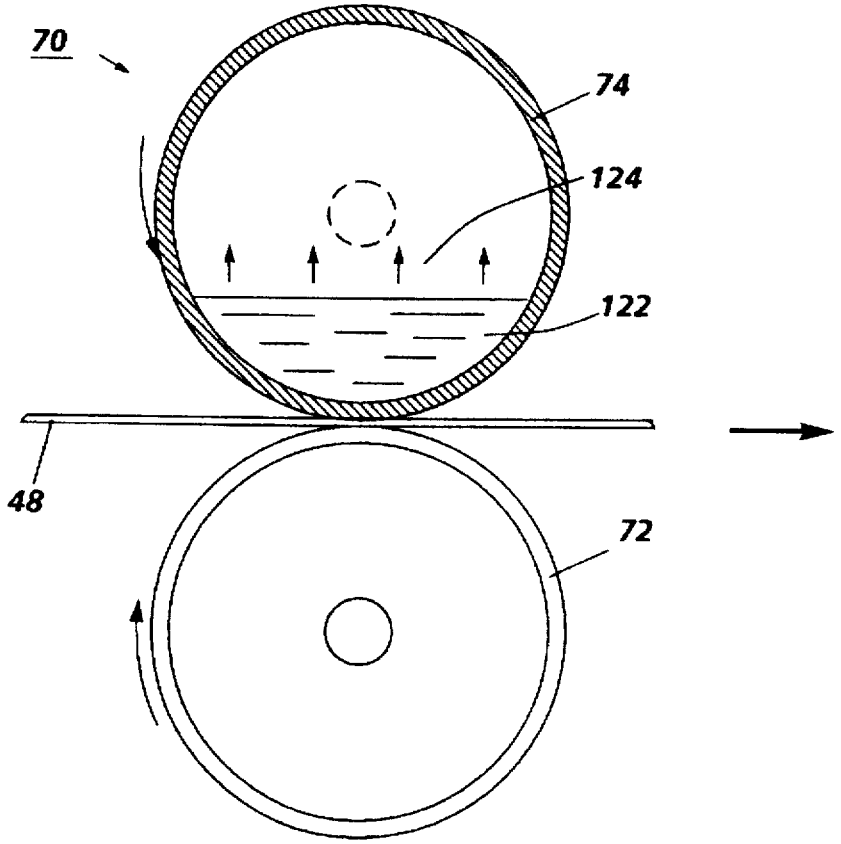
FIG. 3 is a side elevational view of an isothermalizing device as used in a heat and pressure fuser as described herein.

Turning now to FIG. 3 a schematic is shown illustrating the underlying idea to utilize the phase change of a pure substance contained within the sealed chamber of the pressure roll 74 of a heat and pressure fuser in a printing machine. The phase change pressure roll 74 is utilized to correct axial temperature non-uniformities of conventional or low mass fuser rolls.

The sealed chamber, evacuated of air and any other non-condensible substance, should contain only the working fluid in vapor-liquid equilibrium. Water is not viable because for typical fusing temperatures (190° C.) the saturation pressure is an unwieldy 150 psia. Propylene glycol which has a boiling point of 187.2° C. at atmospheric pressure is a good candidate. The roll should be as thin as is structurally viable, having a high radial thermal conductance (e.g. copper).

As the sheet 48 is heated by the fuser roll 72, high temperature regions in the fusing nip (either as the result of lamp profile or rubber to rubber contact)will be locally negated by the increased heat transfer that results from increased rates of evaporation and condensation.

The transport of energy via latent heat produces heat fluxes which, for the same temperature difference, can greatly exceed those due to conduction. Moreover, since correspondingly more energy is removed from hotter regions, any sheet width can be heated uniformly without the occurrence of large axial temperature gradients. The high rate of heat transfer ensures small temperature variations even for very high sheet speeds.

In particular, for low mass, thin fuser rolls, the problem of large axial temperature gradients is aggravated by the reduced area for axial heat conduction. Here, the isothermalizer pressure roll would mitigate high fuser roll temperatures outside the paper path, and drastically improve roll life.

Figure 4:
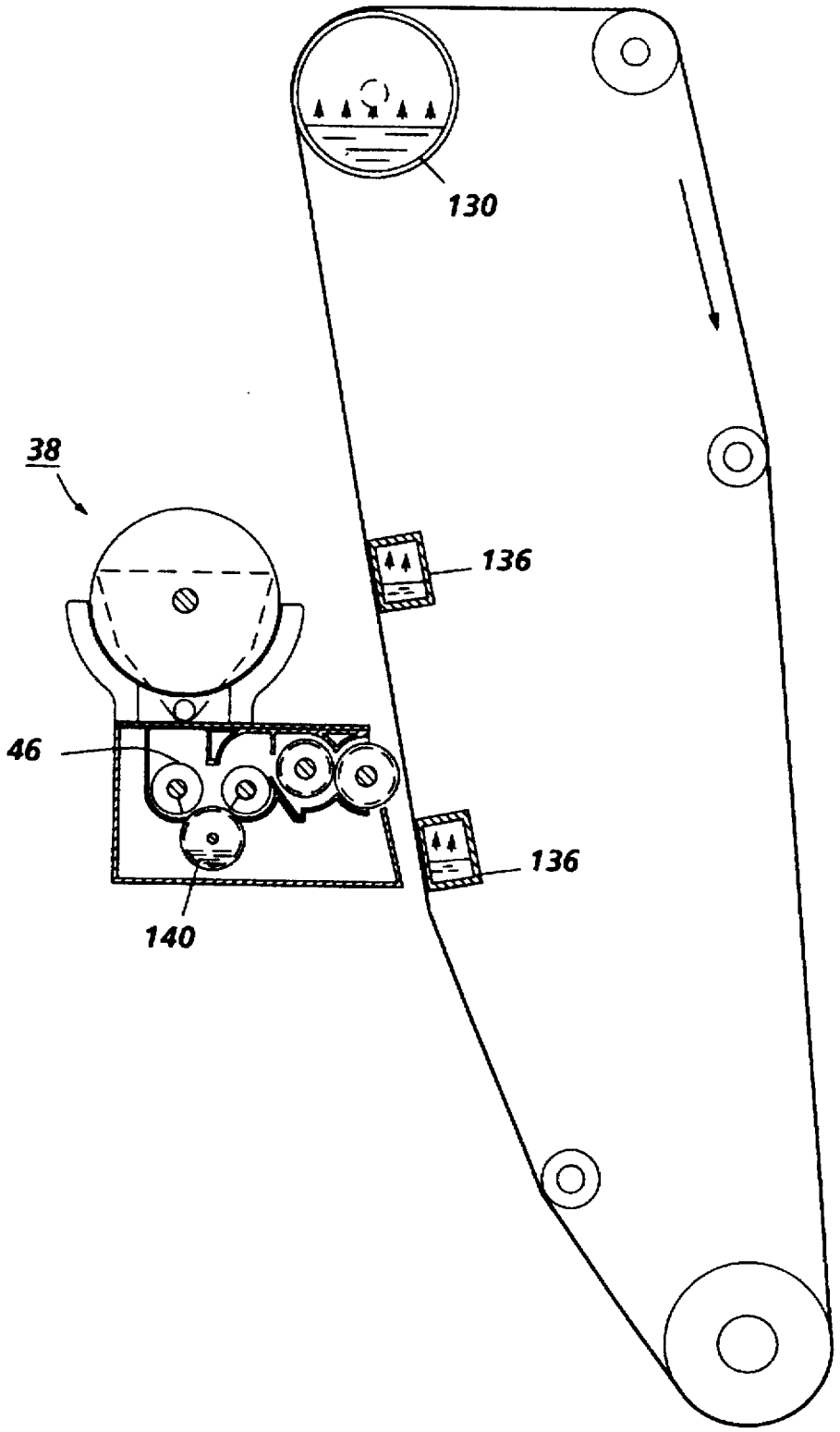
FIG. 4 is an isolated side elevational view of a photoreceptive belt and developer housing using isothermalizing devices for controlling heat as described herein.

Turning now to FIG. 4, there is illustrated an isolated view of a photoreceptor belt and developer housing using isothermalizing members to maintain temperature uniformity. This invention incorporates the phase change of a substantially pure substance or combination of substantially pure substances in a sealed roll or other shaped member such as a backer bar 136 or developer sump member 140. Constant temperature is assured by maintaining equilibrium between the vapor and the liquid, while rapid heat transport occurs as the result of evaporation (cooling hot spots) and condensation (heat, in cold spots). In a belt photoreceptor system or in any belt system, a roll 130 removes temperature nonuniformities created by distributed heat sources in the machine and distributed airflow.

As printing machines move to higher quality, more stringent control of belt temperatures will be required. Heat sources and airflow within printing machines usually result in approximately 10 degree centigrade or more variations across photoreceptor belts from inboard to outboard sides. New requirements call for less than 2 degree centigrade variations. The most convenient place to affect belt temperature is at the large contact areas where the belt is wrapped around rolls. It is likely that the usual rolls also attain the same 10 degree centigrade temperature gradients as the rest of the machine. Clearly an isothermalizing roll 130 is required so that during contact with the rolls the belt temperature is driven toward uniformity. A system of passive rolls and belt would tend to all approach temperature uniformity. The rolls could be simple passive devices or they could be actively temperature controlled with heating or cooling supplied externally or internally. Additionally, backer bars 136, which provide added support for the photoreceptor belt can be made of isothermalizing members which assist in maintaining a uniform belt temperature.

The system shown would passively tend toward a single uniform temperature at which the energy flux into the system would balance the energy flux out of the system. If one of the rolls is heated or cooled to control its temperature at some desired set temperature, the belt and any other passive isothermalizer roll would tend toward the set temperature. If any or all rolls are temperature controlled, the free spans of the belt as well as passive isothermalizer rolls downstream from the controlled temperature roll would acquire the controlled roll temperature provided enough wrap is used on the rolls consistent with belt thickness, speed and belt heat capacity.

Another use of the isothermalizing member 140 is illustrated in FIG. 4. A sealed tubular member 140 is located in contact with the sump 46 of a developer housing 38 or incorporated into one of the rolls within the sump. As the toner particles and carrier particles are mixed and agitated, the developer mixture contacts the isothermalizing member thereby promoting heat transfer and a uniform temperature throughout the mixture.

In recapitulation, there is provided an apparatus for maintaining a uniform temperature along its axis by increasing the heat transfer efficiency. The apparatus uses a sealed chamber containing a pure working fluid at steady state condition. The vaporization and condensation of the fluid increases the heat transfer efficiency and tends to equalize temperature gradients in a body in contact with the apparatus. The apparatus is utilized in various locations in an electrophotographic printing machine and can be used as a pressure roll for a heat and pressure fuser, a support or drive roll for a photoreceptive member, a support member for a photoreceptor and a heat sink for a developer housing.

It is, therefore, apparent that there has been provided in accordance with the present invention, an isothermalizing member that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A printing machine having an apparatus for equalizing the temperature of a body in contact with the apparatus, comprising:

a sealed chamber, wherein said sealed chamber further comprises a sealed cylindrical member supported for rotation about a longitudinal axis thereof; and a fluid contained within said sealed chamber, said fluid being in a two phase condition and the printing machine having a photoreceptive web member for forming images thereon, wherein said photoreceptive web member is supported for movement by said sealed cylindrical member.

2. A printing machine having an apparatus for equalizing the temperature of a body in contact with the apparatus, comprising:

a sealed chamber, wherein said sealed chamber further comprises a sealed cylindrical member supported for rotation about a longitudinal axis thereof; and a fluid contained within said sealed chamber, said fluid being in a two phase condition and the printing machine having a heat and pressure fusing system in which images are fused to a substrate, comprising a heated fusing member and said sealed cylindrical member in circumferential contact with said fusing member to form a pressure nip therebetween.

3. A printing machine according to claim 2, wherein said sealed cylindrical member comprises a conductive metallic roll having an elastomeric coating thereon.

4. A printing machine according to claim 3, wherein said fluid comprises propylene glycol.

5. A printing machine having an apparatus for equalizing the temperature of a body in contact with the apparatus, comprising:

a sealed chamber; and a fluid contained within said sealed chamber, said fluid being in a two phase condition; and the printing machine further comprising a developer housing having a chamber for storing developer mixture therein, said sealed chamber in contact with said developer housing to allow efficient heat transfer within the developer mixture.

6. A printing machine having an apparatus for equalizing the temperature of a body in contact with the apparatus, comprising:

a sealed chamber; and a fluid contained within said sealed chamber, said fluid being in a two phase condition and the printing machine having a photoreceptive web member for forming images thereon, wherein said photoreceptive web member is contacted end supported by said sealed chamber.

7. A method of maintaining a uniform temperature of a body in a printing machine comprising:

maintaining a substantially pure fluid substance in a two phase condition in a sealed member;

contacting the body with the sealed member so that the temperature of the body is equalized by the transfer of heat through the sealed member, wherein said sealed member comprises a support roll in contact with a photoreceptive web member.

8. A method of maintaining a uniform temperature of a body in a printing machine comprising:

maintaining a substantially pure fluid substance in a two phase condition in a sealed member;

contacting the body with the sealed member so that the temperature of the body is equalized by the transfer of heat through the sealed member wherein said sealed member comprises a tubular chamber in contact with a developer housing storage chamber.

9. A method of maintaining a uniform temperature of a body in a printing machine comprising:

maintaining a substantially pure fluid substance in a two phase condition in a sealed member:

contacting the body with the sealed member so that the temperature of the body is equalized by the transfer of heat through the sealed member, wherein said sealed member comprises a tubular chamber inside a developer housing storage chamber.

10. A method of maintaining a uniform temperature of a body in a printing machine comprising:

maintaining a substantially pure fluid substance in a two phase condition in a sealed member;

contacting the body with the sealed member so that the temperature of the body is equalized by the transfer of heat through the sealed member, wherein said sealed member comprises a backer bar in contact with a photoreceptive web member.

* * * * *